US005722437A

United States Patent [19]

Chang

[11] Patent Number: 5,722,437

[45] Date of Patent: Mar. 3, 1998

[54] HAIR CLIP

[76] Inventor: Wen-Hsiung Chang, No. 45, Huan Kung Road, Yung-Kang Shih, Tainan Hsien, Taiwan

[21] Appl. No.: 754,038

[22] Filed: Dec. 3, 1996

[51] Int. Cl.[6] ..... A45D 8/26

[52] U.S. Cl. ..... 132/275; 137/279

[58] Field of Search ..... 132/275, 279, 132/276, 278

[56] References Cited

U.S. PATENT DOCUMENTS

| | | | |
|---|---|---|---|
| 1,374,524 | 4/1921 | Preston | 132/275 |
| 1,624,449 | 4/1927 | Van Sickle et al. | 132/275 |
| 4,912,944 | 4/1990 | Crosley et al. | 132/275 |
| 4,991,607 | 2/1991 | Chen | 132/279 |
| 5,062,436 | 11/1991 | Emsellem | 132/275 |
| 5,154,196 | 10/1992 | Moffat | 132/275 |
| 5,355,899 | 10/1994 | Kuo-Hua | 132/279 |
| 5,605,166 | 2/1997 | Chou | 132/275 |
| 5,609,169 | 3/1997 | Yang | 132/279 |

FOREIGN PATENT DOCUMENTS

| | | | |
|---|---|---|---|
| 341488 | 6/1904 | France | 132/279 |
| 2527057 | 11/1983 | France | 132/275 |

*Primary Examiner*—Paul J. Hirsch
*Attorney, Agent, or Firm*—Morton J. Rosenberg; David I. Klein; Jun Y. Lee

[57] ABSTRACT

A hair clip includes a body, a decorative plate changeably fitting in a shallow recess on an upper surface of the body, and a conventional metal clip assembled together. The body has posts to fit in post holes of the metal clip to combine the both together. The decorative plate has projections to engage holes in the body so as to enable the decorative plate easily released for changing it with different colors and designs.

2 Claims, 3 Drawing Sheets

HAIR CLIP

BACKGROUND OF THE INVENTION

This invention concerns a hair clip, particularly having a decorative plate releasably combined with a body in a secured condition, with the decorative plate changeable so as to make the hair clip have a different decorative plate by choice.

Hair clips are widely used and there are many kinds of them for users to choose, as makers are always supplying new styles and modes. Generally a common conventional hair clip includes a body, a decorative plate and a metal clip combined together. And the body has a shallow recess to correspond to the decorative plate and small projections on a lower surface to fit in holes of the metal clip to combine the both together.

However, conventional hair clips are found to have disadvantages as follows.

1. If different color and designs are wanted, a user has to buy a plurality of different hair clips, resulting in inconvenience and increased expense.
2. A considerable large space is needed for storage of plural hair clips, resulting in a little trouble.

SUMMARY OF THE INVENTION

A main purpose of the invention is to offer a hair clip having a body provided with a shallow recess for a decorative plate to be releasably fitted therein by means of projections of the decorative plate fitting in position holes of the body to secure the plate with the body so that decorative plates of different colors and designs may be changed easily.

BRIEF DESCRIPTION OF DRAWINGS

This invention will be better understood by referring to the accompanying drawings, wherein.

DESCRIPTION OF THE PREFERRED EMBODIMENTS

Figure 1:
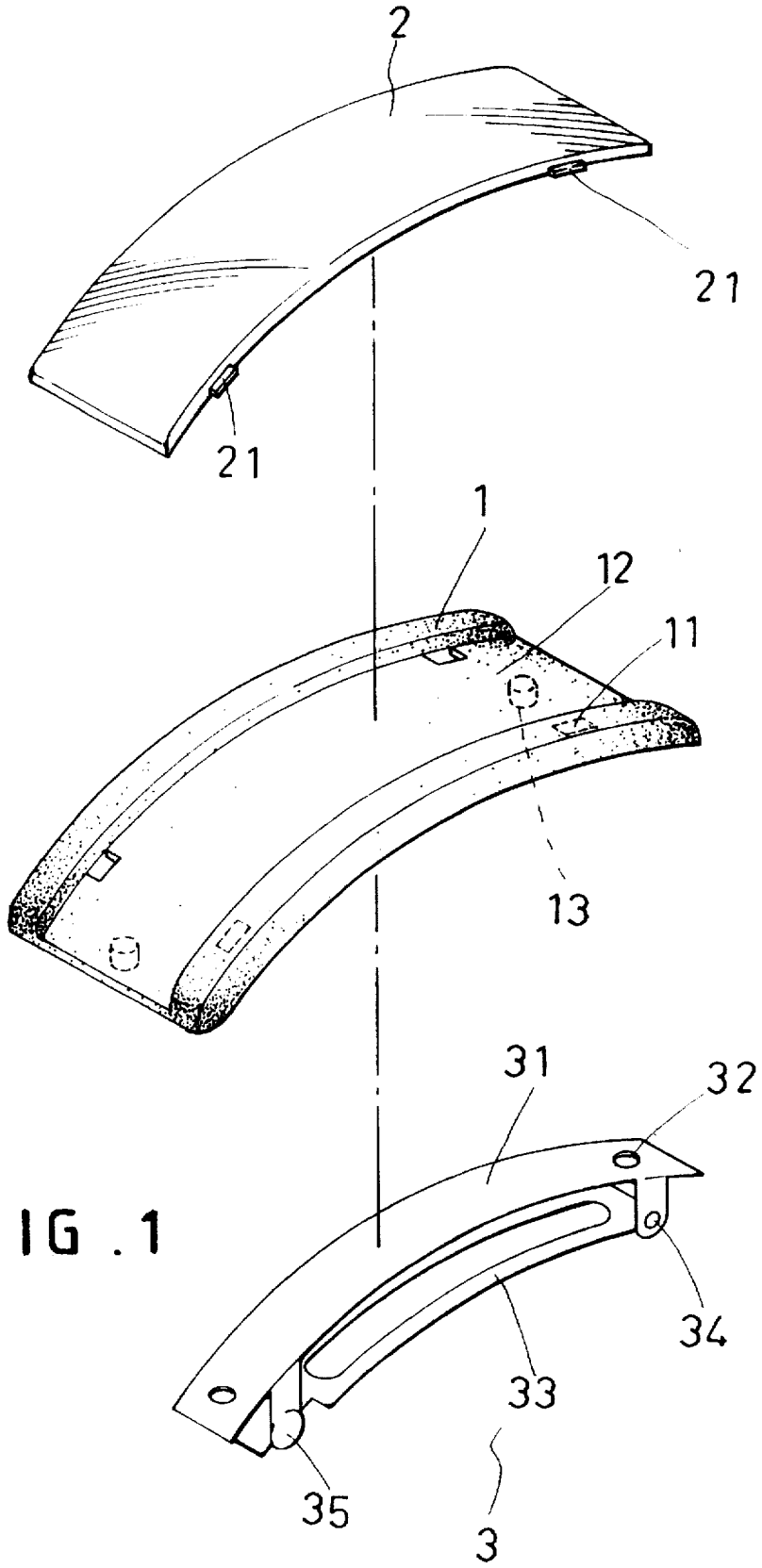
FIG. 1 is an exploded perspective view of a first preferred embodiment of a hair clip in the present invention.

A first preferred embodiment of a hair clip in the present invention, as shown in FIG. 1, includes a body 1, a decorative plate 2, and a conventional metal clip 3 as components assembled together.

The body 1 has a proper shape, a plurality of position holes 11, a shallow recess 12 on an upper surface, and a plurality of projecting-down short posts 13 extending down from a lower surface.

The decorative plate 2 is of such a shape that it fits in the shallow recess 12 of the body 1, having a plurality of projections 21 to fit in the position holes 11 of the body 1. Several decorative plates 2 with different colors and designs may be prepared for change.

The conventional metal clip 3 consists of a curved plate 31 with a hole 32 bored respectively in its two opposite ends, a plate spring 33 located under the curved plate 31 with one end pivotally fitted in a spring securing hole 34 of the curved plate 31 and with the other end pinched in two projecting down clamp plates 35 of the curved plate 31. Then when the two clamp plates 35 are lightly compressed, the plate spring 33 may be released out of the two clamp plates 35.

Figure 4:
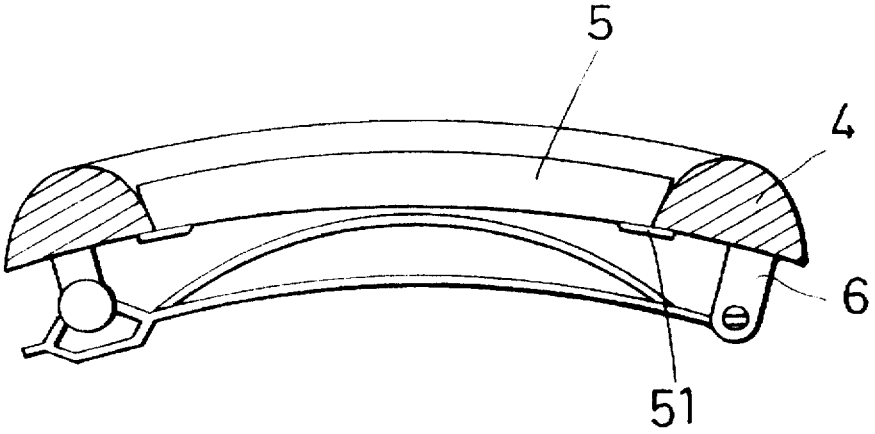
Figure 2:
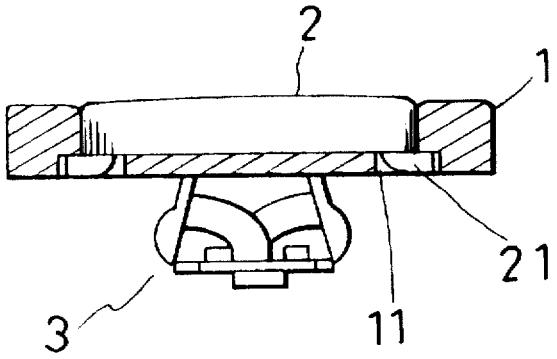
FIG. 2 is a side cross-sectional view of the first preferred embodiment of a hair clip in the present invention.
Figure 3:
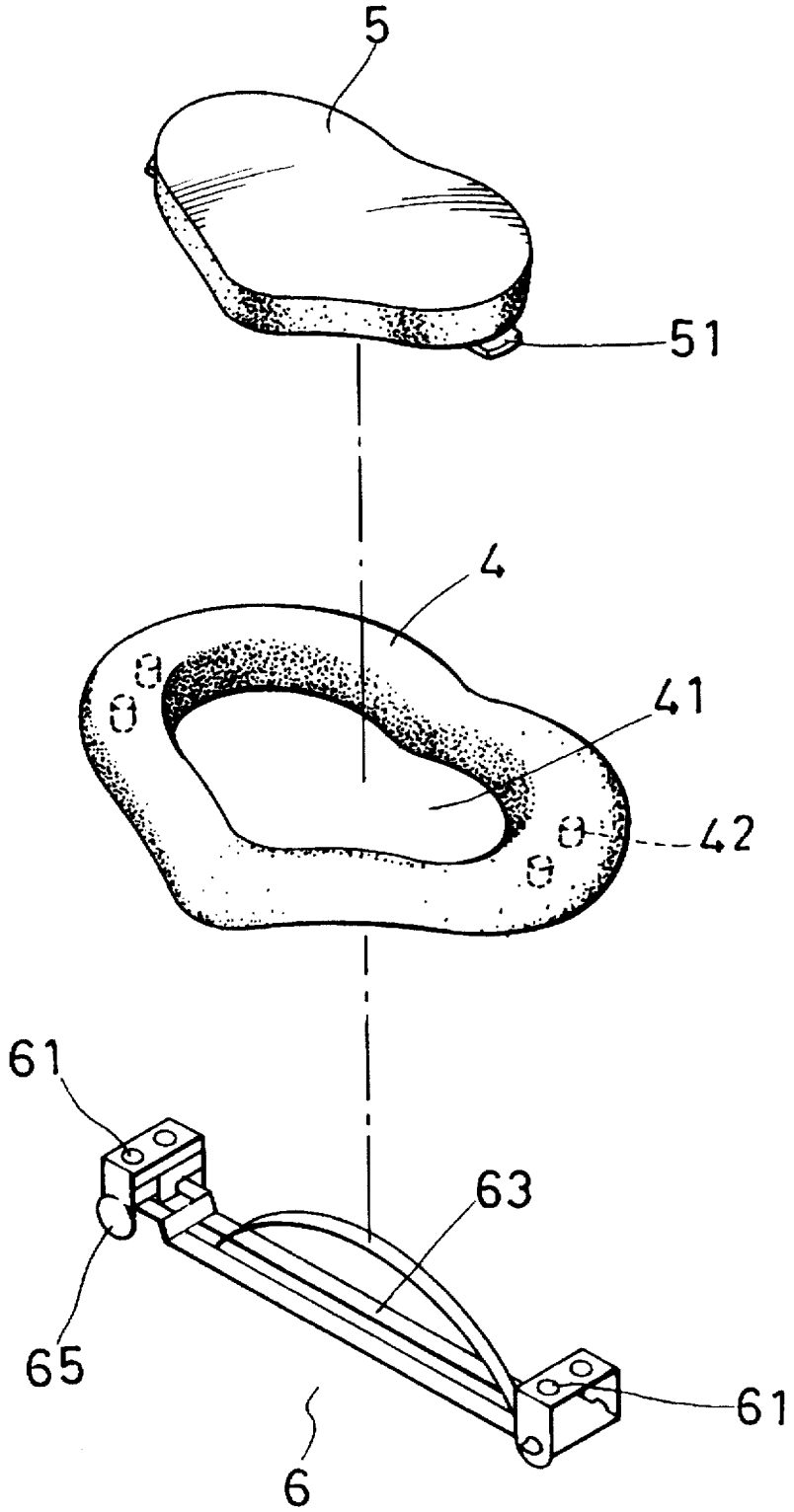
FIG. 3 is an exploded perspective view of a second preferred embodiment of a hair clip in the present invention; and, FIG. 4 is a side cross-sectional view of the second preferred embodiment of a hair clip in the present invention.

A second preferred embodiment of a hair clip in the present invention is shown in FIG. 3 and 4, consisting of a body 4, a decorative plate 5, and a metal clip 6 as components assembled together.

The body 4 has an empty hole 41 defined by a peripheral wall sloping down from an upper surface, and a plurality of posts 42 projecting down from a lower surface.

The decorative plate 5 is of the same shape as the empty hole 41 of the body 4, having a peripheral wall sloping in the same way as the peripheral wall of the empty hole 41 to fit therein, and a projection 51 respectively provided at two opposite ends.

The metal clip 6 has two opposite securing seats 61 respectively with two post holes 62, a plate spring 63, a position hole 64, and a projection 65 respectively extending sidewise from two opposite sides. The posts 42 of the the body fit firmly in the post holes 62 of the metal clip so as to combine the both firmly together.

As can be understood from the above description, the hair clip in the present invention has advantages over the conventional one as follows.

1. A plurality of decorative plates with different colors and designs can be changeably used with the body.
2. In using the hair clip, time for storing away can be saved, and in changing the decorative plates they are able to be done in a DIY mode, increasing pleasure.

While the preferred embodiments of the invention have been described above, it will be recognized and understood that various modifications may be made therein and the appended claims are intended to cover all such modifications which may fall within the spirit and scope of the invention.

What is claimed is:

1. A hair clip comprising:

a metal clip having a curved plate with a plurality of post holes respectively bored in two opposite ends, a plate spring located below said curved plate and having one end secured in a position hole respectively in two side walls projecting down from one end of said curved plate and the other end releasably pinched between two side walls projecting down from the other end of said curved plate;

a body of a proper shape, having a plurality of position holes, a shallow recess provided on an upper surface, and a plurality of short posts extending down from a lower surface;

plural decorative plates of different colors and designs respectively having a plurality of projections extending out from two opposite longitudinal sides to fit in said position holes of said body; and said metal clip combined with said body by means of said posts of said body engaging with said post holes of said metal clip, said decorative plates being combined with said body in said shallow recess and secured with said projections being pressed to firmly engage with said position holes to become a hair clip said decorative plates being changeable so as to allow said hair clip to have a different decorative plates at one time.

2. The hair clip as claimed in claim 1, wherein said body has an empty hole instead of said shallow recess, and plural decorative plates respectively shaped the same as the shape of said empty hole and having different colors and designs to fit firmly in said empty hole.

* * * * *